US005909654A

United States Patent [19]

Hesböl et al.

[11] Patent Number: 5,909,654

[45] Date of Patent: Jun. 1, 1999

[54] METHOD FOR THE VOLUME REDUCTION AND PROCESSING OF NUCLEAR WASTE

[76] Inventors: Rolf Hesböl, 4 Sagostigen, Nyköping, Sweden, S-611; J. Bradley Mason, 221 Doulton Way, Columbia, S.C. 29212

[21] Appl. No.: 08/680,380

[22] Filed: Jul. 15, 1996

Related U.S. Application Data

[63] Continuation-in-part of application No. 08/403,758, Mar. 17, 1995, Pat. No. 5,536,896.

[51] Int. Cl.[6] ..... G21F 9/00

[52] U.S. Cl. ..... 588/19; 588/205; 588/213; 588/226; 588/228; 110/237; 110/346

[58] Field of Search ..... 588/19, 205, 213, 588/226, 228; 110/237, 346

[56] References Cited

U.S. PATENT DOCUMENTS

| | | | |
|---|---|---|---|
| 2,513,022 | 6/1950 | Helmers et al. . | |
| 2,539,466 | 1/1951 | Parry . | |
| 2,619,415 | 11/1952 | Hemminger . | |
| 2,623,815 | 12/1952 | Roetheli et al. . | |
| 2,633,416 | 3/1953 | Goronowski et al. . | |
| 2,680,065 | 6/1954 | Atwell . | |
| 2,683,657 | 7/1954 | Garbo . | |
| 2,772,954 | 12/1956 | Jequier . | |
| 2,937,500 | 5/1960 | Bodine, Jr. . | |
| 2,979,390 | 4/1961 | Garbo . | |
| 3,304,249 | 2/1967 | Katz . | |
| 3,333,619 | 8/1967 | Denis . | |
| 3,522,019 | 7/1970 | Buswell et al. . | |
| 3,606,867 | 9/1971 | Briffa . | |
| 3,624,176 | 11/1971 | Lhonore et al. . | |
| 3,737,291 | 6/1973 | Lhonore et al. . | |
| 3,861,885 | 1/1975 | Schora . | |
| 3,884,649 | 5/1975 | Matthews . | |
| 3,890,112 | 6/1975 | Aldridge . | |
| 3,891,403 | 6/1975 | Weil et al. . | |
| 3,918,374 | 11/1975 | Yamamoto et al. . | |
| 3,957,459 | 5/1976 | Mitchell et al. . | |
| 3,966,634 | 6/1976 | Sacks . | |
| 4,017,272 | 4/1977 | Anwer et al. . | |
| 4,053,432 | 10/1977 | Tiepel . | |
| 4,056,602 | 11/1977 | Matovich . | |
| 4,059,416 | 11/1977 | Matovich . | |
| 4,157,245 | 6/1979 | Mitchell et al. . | |
| 4,157,959 | 6/1979 | Wen et al. . | |
| 4,218,427 | 8/1980 | Yan . | |
| 4,226,830 | 10/1980 | Davis . | |
| 4,263,125 | 4/1981 | Weil et al. | 208/8 R |
| 4,289,625 | 9/1981 | Tarman . | |
| 4,292,048 | 9/1981 | Wesselhoft . | |
| 4,309,198 | 1/1982 | Moss . | |
| 4,315,758 | 2/1982 | Patel et al. | 48/197 K |
| 4,331,451 | 5/1982 | Isoqaya et al. . | |
| 4,368,677 | 1/1983 | Kline . | |
| 4,369,045 | 1/1983 | Vorres . | |
| 4,416,857 | 11/1983 | Vorres . | |
| 4,435,364 | 3/1984 | Vorres | 422/145 |
| 4,436,532 | 3/1984 | Yamaguchi et al. | 48/209 |
| 4,439,272 | 3/1984 | Nguyen | 162/30.11 |
| 4,483,691 | 11/1984 | McShea, III et al. | 48/202 |
| 4,522,685 | 6/1985 | Feldmann | 162/30.11 |
| 4,526,712 | 7/1985 | Hirano et al. . | |
| 4,526,903 | 7/1985 | Cummings | 518/704 |
| 4,529,377 | 7/1985 | Zinn et al. | 423/58 |
| 4,544,375 | 10/1985 | Rehmat et al. | 48/197 |
| 4,546,111 | 10/1985 | Banquy | 518/703 |
| 4,555,361 | 11/1985 | Buckley et al. . | |
| 4,569,696 | 2/1986 | Sandstrom et al. | 134/2 |
| 4,578,175 | 3/1986 | Gorin | 208/8 R |
| 4,592,762 | 6/1986 | Babu et al. | 48/197 R |
| 4,628,837 | 12/1986 | Mori et al. | 75/450 |
| 4,636,335 | 1/1987 | Kawamura et al. | 110/346 |
| 4,654,172 | 3/1987 | Matsuda et al. | 252/629 |
| 4,655,146 | 4/1987 | Lemelson | 110/346 |
| 4,656,147 | 4/1987 | Iida et al. | 502/26 |
| 4,664,678 | 5/1987 | Rehmat et al. | 48/62 R |
| 4,682,985 | 7/1987 | Kohl | 48/197 R |
| 4,688,495 | 8/1987 | Galloway | 110/250 |
| 4,699,580 | 10/1987 | Co | 425/140 |
| 4,699,588 | 10/1987 | Zinn et al. | 423/58 |
| 4,699,632 | 10/1987 | Babu et al. | 48/197 R |
| 4,708,159 | 11/1987 | Lockwood, Jr. | 137/340 |
| 4,770,626 | 9/1988 | Zinn et al. | 431/1 |
| 4,773,918 | 9/1988 | Kohl | 48/197 R |
| 4,782,096 | 11/1988 | Banquy | 518/704 |
| 4,808,264 | 2/1989 | Kignell | 162/30.1 |
| 4,822,935 | 4/1989 | Scott | 585/240 |
| 4,854,249 | 8/1989 | Khinkis et al. | 110/342 |
| 4,865,625 | 9/1989 | Mudge et al. | 48/197 R |

(List continued on next page.)

FOREIGN PATENT DOCUMENTS

| | | |
|---|---|---|
| 2301633 | 9/1976 | France . |
| 2741805 | 3/1979 | Germany . |
| 3109685 | 9/1982 | Germany . |
| 879146 | 11/1981 | U.S.S.R. . |
| 644013 | 10/1950 | United Kingdom . |
| 665723 | 1/1952 | United Kingdom . |
| 665728 | 1/1952 | United Kingdom . |
| 1544446 | 4/1979 | United Kingdom . |
| 8200047 | 1/1982 | WIPO . |

OTHER PUBLICATIONS

SITE Technology Profile—Emerging Technology Program, "Institute of Gas Technology (Fluidized–Bed Cyclonic Agglomerating Combustor)", pp. 310–311, Nov. 1993.

*Primary Examiner*—Ngoclan Mai

*Attorney, Agent, or Firm*—Andrew F. Strobert; Skadden, Arps, Slate, Meagher & Flom LLP

[57] ABSTRACT

A method and apparatus for the volume reduction and processing of solid organic waste, in particular ion exchange media from nuclear facilities containing sulfur or chlorine. A method and apparatus for the volume reduction of nuclear waste is disclosed comprising: subjecting the waste to pyrolysis in a pyrolysis vessel, and gasifying the solid pyrolysis residue in a steam reformer to remove residual carbon. A further method and apparatus for the processing of nuclear waste is disclosed comprising: grinding the nuclear waste, addition of iron powder, pyrolysis, gasification of the pyrolysis residue, and combustion in a submerged bed heater. An evaporator cools gases from the submerged bed heater. Off gases from the evaporator are treated by a fiber bed scrubber to remove acids.

39 Claims, 2 Drawing Sheets

U.S. PATENT DOCUMENTS

| | | | |
|---|---|---|---|
| 4,874,587 | 10/1989 | Galloway | 422/189 |
| 4,885,079 | 12/1989 | Eppig et al. | 203/13 |
| 4,909,731 | 3/1990 | Zinn et al. | 432/58 |
| 4,951,613 | 8/1990 | Harandi et al. | 122/4 D |
| 4,966,101 | 10/1990 | Maeda et al. | 122/4 D |
| 5,059,404 | 10/1991 | Mansour et al. | 423/201 |
| 5,092,984 | 3/1992 | Babu et al. | 208/409 |
| 5,120,691 | 6/1992 | Pontier et al. | 502/44 |
| 5,133,297 | 7/1992 | Mansour | 122/4 D |
| 5,158,449 | 10/1992 | Bryan et al. | 432/15 |
| 5,160,456 | 11/1992 | Lahn et al. | 252/373 |
| 5,255,634 | 10/1993 | Mansour | 122/4 D |
| 5,306,481 | 4/1994 | Mansour et al. | 423/652 |
| 5,307,748 | 5/1994 | Khinkis et al. | 110/346 |
| 5,322,116 | 6/1994 | Galloway et al. | 168/133 |
| 5,424,042 | 6/1995 | Mason et al. | 422/159 |
| 5,427,738 | 6/1995 | Galloway | 422/26 |
| 5,470,544 | 11/1995 | Galloway | 423/213 |
| 5,536,488 | 7/1996 | Mansour et al. | 423/652 |

METHOD FOR THE VOLUME REDUCTION AND PROCESSING OF NUCLEAR WASTE

RELATED APPLICATIONS

This application is a continuation-in-part of U.S. patent application Ser. No. 08/403,758, filed on Mar. 17, 1995, U.S. Pat. No. 5,536,896, entitled "Waste Processing" by Rolf Hesböl and Lars E. Holst and assigned to the assignee of the present invention.

FIELD OF INVENTION

The present invention relates to the field of processing organic waste, "processing" in the present case referring to the breaking down of said waste via the thermal route with the primary aim of affording opportunities for reducing its volume to thereby lessen handling and storage problems. More particularly, it concerns a new method and new apparatus for processing solid organic sulphur or chloride containing waste in which the carbon content of solid residue resulting from an initial pyrolysis of the waste is gasified.

BACKGROUND TO THE INVENTION

The new method of the present invention not only achieves the aim of volume reduction, but also provides, for example, such benefits as the elimination of sulphur or chloride content from exhaust gases, and similarly any radioactive content, in an effective and straight forward manner. The invention is therefore especially useful for the processing of ionic exchange media from nuclear facilities, which media display a certain degree of radioactivity and therefore would otherwise require conventional measures in relation to ultimate waste disposal and deposition. The nuclear industry annually produces a significant amount of waste which is classified as radioactively contaminated ion exchange media. Such waste is managed in various fashions prior to ultimate disposal in bedrock chambers or shallow land burial. This management is technically complex and as a rule leads to increased volumes which influences storage costs. A process resulting in diminished volume at reasonable cost is therefore highly commercially desirable.

Ion exchange medium is an organic material. The base is usually a styrene polymer with grafted sulfonic acid and amine groups. The material is therefore burnable, but air is supplied during combustion and sulphur and nitrogen oxides are formed which in turn must be separated in some manner. Additionally, during combustion the temperature becomes sufficiently high for radioactive cesium to be partially vaporized. The residual radioactivity will also accompany the resulting fly ash to some extent. This necessitates a very high performance filter system. Accordingly, both technical and economic problems are typically associated with standard combustion techniques.

An alternative to straight combustion is pyrolysis. However, previously known pyrolysis methods in this technical field are deficient in several aspects and in particular no one has earlier succeeded in devising a pyrolysis process which provides a comprehensive solution to the problem of sulphur and nitrogen-containing radioactive waste, and to do so under acceptable economic stipulations. The following can be mentioned as examples of the known technology in this respect:

U.S. Pat. No. 5,424,042 to J. Bradley Mason et al. describes a system for vitrification of nuclear waste (incorporating of a portion of the nuclear waste into a stable glass matrix) including several subsystems: a feed conditioning system for conditioning "dry waste," "wet waste" or ion exchange resins and "liquid waste"; a feed preparation system for blending the waste types; a feed melter chamber with an upper zone and a lower zone for oxidizing the waste into ash and off-gas; a glass handling system for packing and storing the glass product; and an off-gas cleaning and control system.

U.S. Pat. No. 5,470,544 describes a system for the detoxification of hazardous waste utilizing a moving bed evaporator and a steam-reforming detoxification reactor. U.S. Pat. No. 5,427,738 also describes a system for the detoxification of solid waste which first mechanically particularized the waste in a spinning knife cutter, size reduction grinder or like device, and then subjects the particularized waste to a gas flow of a hot gas in the range of 250–750° C. The particularized waste is agitated to enhance exposure to the hot gaseous flow.

SE-B 8405113-5 which describes single stage pyrolysis in a fluidised bed followed by conversion of tars in the resulting gas to non-condensable gas using limestone as catalyst.

U.S. Pat. Nos. 4,628,837, 4,636,335, and 4,654,172 describe pyrolysis of ion exchange resins where the pyrolysis is carried out in two stages. Both of these stages, however, are directed towards pyrolysis of the ion exchange media itself, i.e. the solid product. Speaking generally, both stages moreover are carried out at relatively low temperatures. Furthermore, none of these specifications recites any comprehensive solution to the problem of solid organic sulphur or chloride containing waste such as is the case with the method of the present invention.

SUMMARY OF THE INVENTION

The principal objective of the present invention is to provide a method and apparatus for processing solid wastes of the above-mentioned type, which method results in a "dead" (to use a biological term) pyrolysis residue and thereby an effective reduction in the volume of the waste.

Another objective of the invention is to provide a method and apparatus which, in addition to the above-mentioned volume reduction, affords effective processing of the resulting exhaust gases.

Another objective of the present invention is to provide a method and apparatus for the further reduction of the pyrolysis residue volume through the gasification of at least a portion of the carbon content of the pyrolysis residue.

A further objective of the invention is to provide a method and apparatus which also affords an extremely high retention of the radioactivity present in the pyrolysis residue.

A still further objective of the invention is to provide a method and apparatus which is straight forward in technical respects and which is therefore also cost effective taking everything into account as regards volume reduction of the solid waste and management of the resulting exhaust gases.

The above-mentioned objectives are attained by pyrolyzing the solid waste at a relatively low temperature. The pyrolysis residue is passed through a steam reformer to gasify the carbon content of the solid residue. The resulting gases from the pyrolysis vessel and steam reformer vessel are mixed and oxidized (combusted) in a submerged bed heater. Residual acid gases and particulates are removed from the offgas stream by a fiber bed scrubber. The method and apparatus of the present invention can process sulfur and chloride containing waste having high organic content, including salt depleted resins, steam generator cleaning solutions, antifreeze and sludges.

BRIEF DESCRIPTION OF THE DRAWINGS

For a more complete understanding of the present invention, reference is made to the following Detailed Description taken in conjunction with the accompanying drawings in which.

DETAILED DESCRIPTION

Figure 1A:
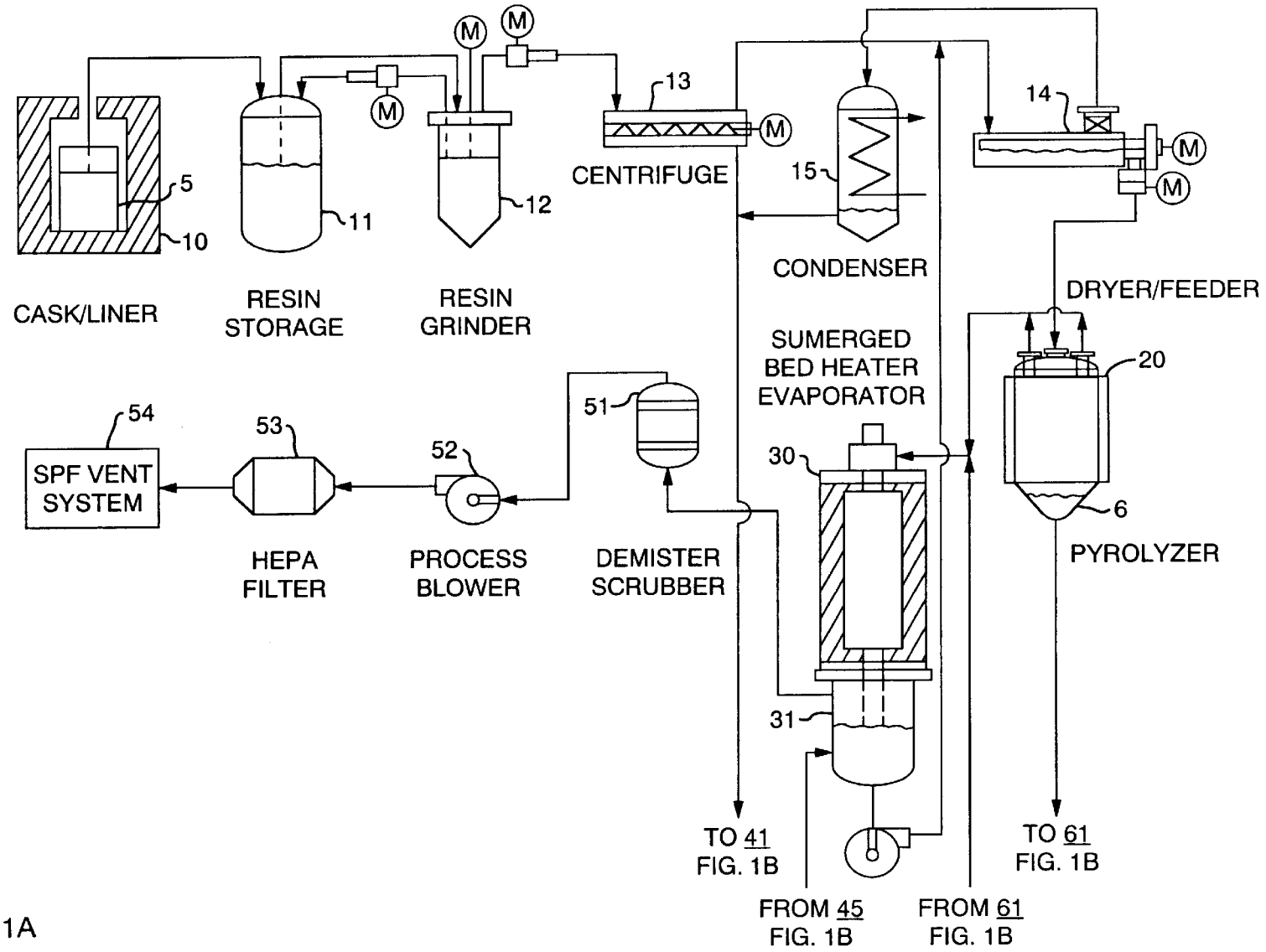
FIGS. 1A and 1B are diagrams of a system embodying the present invention.
Figure 1B:
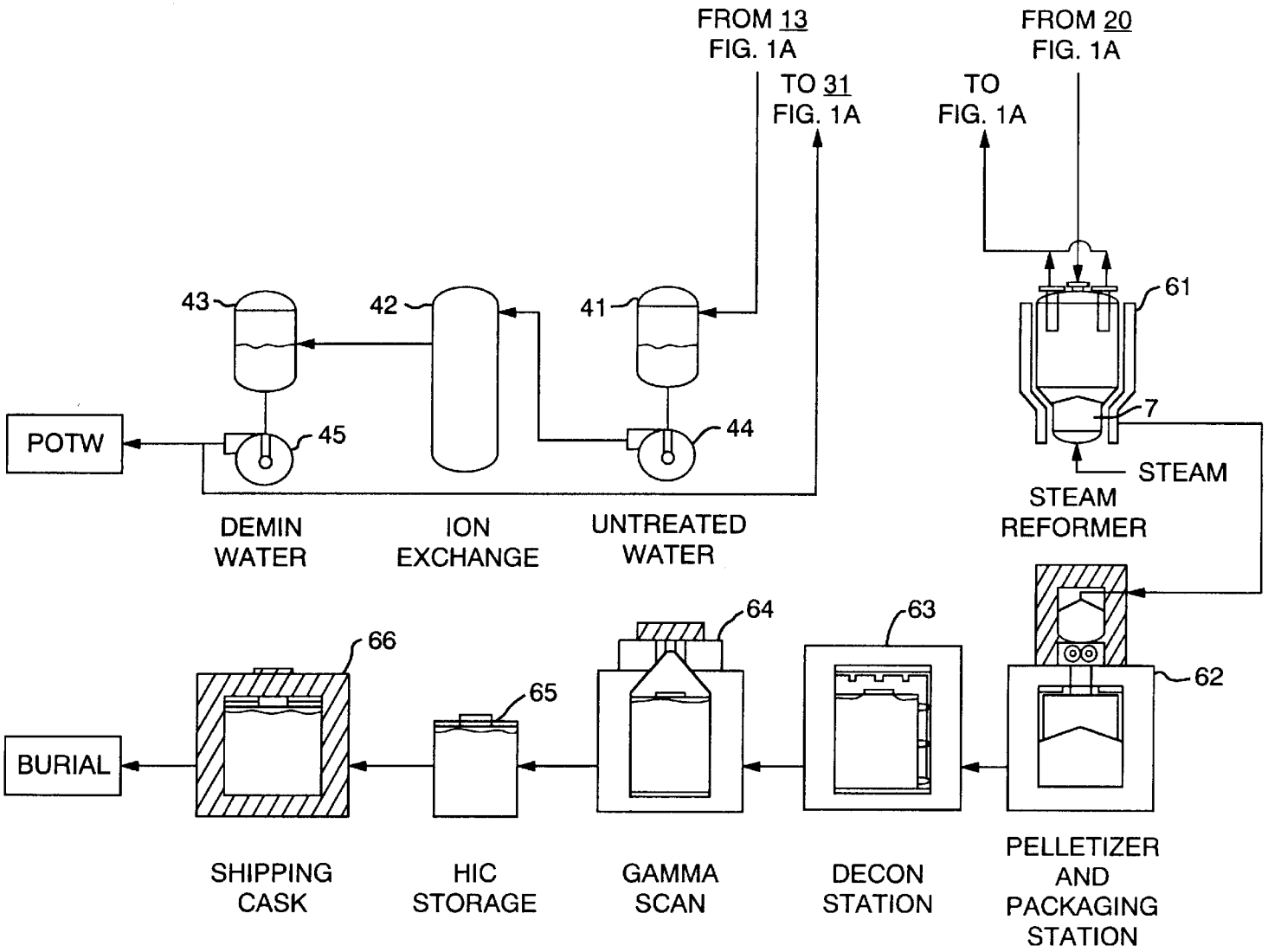

Preferred embodiments of the present invention will now be described with continued reference to the drawings.

The sulphur or chloride containing waste is subjected to pyrolysis at a temperature of no more than 700° C., and preferably no more than 600° C., to form a gas which contains organic sulphur or chloride compounds and a solid pyrolysis residue which contains radioactive material from the waste.

The pyrolysis residue (ash) 6 is fed to a steam reformer 61 to gasify the residual carbon. Significant volume reduction and overall cost savings to the waste generator can be realized by gasifying the carbon content of the solid pyrolysis residue (ash) 6 to $CO_2$ or CO. The final waste residue 7 can be reduced from the volume of the pyrolysis residue 6 by a factor of 2 to 5 times. The steam reformer 61 is preferably a fluid bed or rotary contact design. An optional compressing device may be added for further reducing the residue volume.

The final waste residue 7 from the steam reformer 61 is pelletized and packaged 62. The residue pellet package 62 is decontaminated 63 and gamma scanned 64 through standard procedures known in the art. The residue pellet package 62 is stored 65 until prepared for final shipment 66 for burial.

Gases from both the pyrolysis reactor 20 and the steam reformer 61 are preferably mixed and oxidized (combusted) in a submerged bed heater (afterburner) 30 operating at a preferred temperature of 1800–2200° F. The present invention overcomes many of the problems of sulfur and nitrogen oxide formation during standard combustion of ion exchange media. The pyrolysis step utilizes substoichiometric quantities of air which forms a reducing atmosphere. In such reducing conditions sulfur forms $H_2S$, or in the presence of Fe it readily forms FeS and/or $FeS_2$. The nitrogen components remain as $N_2$, and minimal $NO_x$.

Although described herein as utilizing a two stage process of pyrolysis-combustion, the steam reformer process of the present invention may also be used with other treatment process, such as the two stage pyrolysis-pyrolysis process described in copending U.S. application Ser. No. 08/403,758.

Heat recovered from the submerged bed heater 30 may be used to heat the process facility and/or to provide heat to dry the resin as described below or to evaporate water from dilute solutions to provide concentration.

The gases from the submerged bed heater are quickly reduced in temperature by a submerged bed evaporator (quencher). The use of a submerged bed evaporator allows the water temperature to be closely controlled to provide zero liquid discharge from the facility by vaporizing all of the process water. The vaporized process water is then passed out the exhaust stack as gaseous discharge. The submerged bed evaporator also serves as a scrubber to remove acid gases from the offgas stream. The acid gases are converted to salts which are concentrated to 5–15% wt. solids by the removal of water to offgas. This avoids the need for a separate concentrator unit.

The offgas stream is fed to a standard, commercially-available, fiber bed scrubber 51 to remove residual acid gases and particulates. The fiber bed scrubber 51 preferably provides a low pressure drop of 5 to 10 inches of water and preferably removes more than 99% of particulates and entrained mists.

The pyrolysis step involves subjecting the solid waste to pyrolysis at a temperature of no more than 700° C., and preferably not more than 600° C. The term "pyrolysis" is used herein in its conventional sense, i.e. chemical decomposition or breakdown of a substance by the action of heat and without any real supply of oxygen or at least so little oxygen supply that no real combustion is effected. The pyrolysis thereby leads to breaking down of the carbonaceous waste to a relatively fluffy pyrolysis residue which can be drawn off from the bottom of the pyrolysis reactor employed and can thereafter be imparted a significantly smaller volume by gasifying the carbon content of the residue, and, optionally compression.

Additionally, by keeping the temperatures no higher than those recited above, practically speaking all of the radioactive materials, in particular $^{134}Cs$ and $^{137}Cs$, are retained in the pyrolysis residue and therefore measures and consequent costs to remove additional radioactivity can be minimized. Any fly ash formed can, however, be removed from the resulting gas in a per se known manner, preferably in a ceramic or metal filter in the pyrolysis reactor. In this way, the radioactive material in the fly ash caught in the filter can be returned to the pyrolysis residue.

In the practice of the invention, it has proven possible in this fashion to attain very high retention of the radioactivity in the pyrolysis residue. In this regard, trials carried out on ion exchange media from a nuclear power station show a retention of almost $10^6$:1, i.e. the decontamination factor ("DF") is of the order $10^6$. Aside from said radioactive material, the pyrolysis residue contains carbon and possibly iron compounds such as iron oxides and iron sulphides. Trials in this connection, show the retention of sulphur, in the pyrolysis residue to be >90%.

No immediately critical lower limit is apparent for the pyrolysis in the pyrolysis reactor 20 but rather this limit is dictated, if anything, by effectiveness and/or cost. However, for practical purposes, a lower limit can generally be set at 400° C. and therefore a preferred embodiment of the method of the invention involves the pyrolysis unit 20 being operated at a temperature in the range 400–700° C., preferably 400–600° C., especially 450–600° C., and most preferably 450–550° C.

Additionally, as the method of the invention as a whole has proven to be extremely effective both as regards the solids content and the evolved cases, the pyrolysis stage is preferably carried out without any catalyst for the breakdown of the carbon compounds in the waste which, of course, means that the method of the invention is very cost effective as the catalyst costs in comparable contexts often represent a large part of the total costs.

The pyrolysis stage can be carried out in per se known fashion as regards the type of pyrolysis reactor 20, e.g. in a fluidised bed, but in the overall set-up of the method in the context of the invention, "flash pyrolysis" has proven to give exceptionally good results. The expression flash pyrolysis is used herein in its conventional sense, i.e. with a relatively rapid, flow-through of material. In other words, it is a matter of a short residence time, normally less than 30 seconds and even more usually a significantly shorter time, e.g. less than 15 seconds. An especially preferred "flash pyrolysis" is carried out in a gravity or flash reactor for which a suitable residence time can be 3–15 seconds, even better 4–10 seconds and most preferred 5–8 seconds such as around 6 seconds. Suitable residence times are, however, easily determined by the man skilled in the art in each individual case.

An important additional consideration found is that the flash pyrolysis process of resins for about 5–8 seconds can be used under high throughput production operations. The flash pyrolysis of resins will convert the external surface of small resin particles. Subsequent residence times in the bottom of the pyractor vessel 20 for about 0.1–1 hours will complete the pyrolysis conversion. The particles have been found not to stick or adhere to each other because any incomplete flash pyrolysis that occurs in the drop zone is sufficient to convert the outer surface, thus preventing adhesion between the hot particles which accumulate in the bottom of the pyractor vessel 20.

The pyractor 20 is a gravity drop vessel and may utilize either multiple drop tubes or a single large diameter drop.

In the present case, it will be understood that "solid waste" does not concern a solution of the material in question. It need not however necessarily concern a dry material but also material with a certain degree of moisture content, e.g. up to 50%, usually 10–30% such as is often the case when using ion exchange media. However, for flash pyrolysis, for example, it can be convenient to condition the material prior to pyrolysis, which means a certain degree of drying and optionally, comminution. In this regard, a material in powder form has proven to give very good results in the initial pyrolysis step.

The ion exchange medium is fed from a cask/liner 10 to a resin storage container 11. The ion exchange medium 5 is preferably ground in a grinder 12, centrifuged 13, and dried in a dryer/feeder 14, prior to being fed into the pyrolysis vessel 20. Excess gas/vapor from the dryer/feeder 14 is fed to condenser 15. Water from condenser 15 is pumped 44 from container 41 to ion exchange unit 42. The ionized water is stored in container 43 and pumped 45 with tap water to the submerged bed evaporator 31.

Fine iron powder, preferably $Fe_2O_3$, may be added with the resin feed to the pyrolysis vessel 20. The Cl from chloride containing waste combines with the iron in the pyrolysis vessel 20 to form $FeCl_2$, which is an inert, high melting point inorganic solid which will remain in the carbon rich residue. Sulfur containing wastes effectively combine with the iron powder to form FeS and $FeS_2$ compounds.

The fine iron oxide powder will also collect on the ceramic or metal filters exhausting the offgas from the pyrolysis vessel 20 to the submerged bed heater 30. The iron powder effectively converts $H_2S$ to FeS and $SO_2$ to $H_2S$ and to FeS.

The gas, which is formed during the pyrolysis step, contains decomposition products from the organic waste referred to as "tars". These tars principally contain pure hydrocarbons and water vapor, and organic sulphur or chloride compounds and amines when the waste is of the nitrogen and sulphur or chloride containing ion exchange media type. The gas is separated from the pyrolysis residue and subjected to oxidation (combustion) in a second stage 30.

When the gases from the pyrolysis vessel 20 and the steam reformer 61 contain tar products and water, a preferred embodiment of the method of the invention will subject the gas, prior to being fed to the submerged bed heater, to condensation conditions such that tar products therein condense out and are separated before the gas is conducted to said submerged bed heater 30. In this context, "tar products" will be understood to include carbonaceous compounds which are, of course, in gaseous form after pyrolysis in the first stage but which drop out in the form of a more or less viscous tar mixed with water. The condensate can be separated by fractionated condensation (not shown) into a low viscosity tar of high calorific value, water and a viscous sulphur-rich tar.

If sulphur oxides, especially $SO_2$, are present in the cases emanating from the pyrolysis vessel 20, they must be attended to in an appropriate manner bearing in mind the strict requirements which now apply to the release of sulphur oxides and other sulphur compounds.

As noted above, this may be directly attained by feeding offgases to a demister/fiber bed scrubber 51. The demisted gases are pumped 52 to a HEPA filter 53 and then vented through a standard ventilation stack 54 with radiation monitors.

One alternate method for attending to any sulfur oxides present in the offgas is to expose the offgas from the submerged bed evaporator 31 to a bed (not shown) of a solid reductant under reducing conditions so that the sulphur oxides are reduced, principally to hydrogen sulfide and carbon disulfide. Carbon, in particular, has proven to work extremely well as a reductant in relation to the method of the invention. Additionally, carbon results in the sort of end products, especially carbon dioxide, which are harmless and in principle can be released direct to the atmosphere.

The temperature for the reduction is selected by one skilled in the art in this field in such a fashion that the sought after reactions are attained. The reduction is carried out at a temperature in the range 700° C. to 900° C., the approximately 800° C. temperature level probably lying near the optimum. Alternately, one may add air to the reformer, allowing operation to as low as 375° C. The reduction bed additionally leads to a reduction in nitrogen oxides in the event that these are present in the gas after the pyrolysis steps. In the event that a high temperature filter of the carbonaceous filter type or similar is utilized for filtering out the soot in the reformer offgas, this filter can be regarded as a reduction means for use in this optional reduction step of the invention.

Finally, the gas may optionally be exposed to a bed (not shown) of a sulphide-forming metal under conditions in which the remaining sulphur compounds form metal sulphides with said metal. In this context, it is the gas from the prior optional reduction step, if present, or the gas from the submerged fuel evaporator 31. In each case it is primarily a matter of transforming hydrogen sulfide to metal sulfide. Preferably, iron is used as sulfide-forming metal as iron is a cheap material and results in a harmless product, principally in the form of the iron disulfide, pyrite. Other metals, however, are also conceivable of which nickel can be mentioned as an example. The temperature for this optional step is also selected by the man skilled in the art in this field so that the sought after reactions are attained. An especially preferred temperature range, however, is 400–600° C. the approximately 500° C. level being especially suitable in many cases.

As has been touched upon earlier, both the solid end-product and the gaseous end-products of the method of the invention are amenable to handling. The resulting ash, for example, is thus particularly suitable for post-treatment in the form of simple compression, where the practice of the invention has proven that the volume can be reduced by as much as up to 75%. Furthermore, the resulting gases are rich in light organic compounds which implies a gas with a high heat content which can be burnt. Additionally, the sort of gases being referred to are non-injurious to the surroundings, e.g. carbon dioxide, gaseous nitrogen, gaseous hydrogen and water vapor, and therefore the method of the invention, as a whole, represents unparalleled advantages in relation to the known technique.

In order that the method should proceed in an effective fashion and especially in order that the release of radioactive or unpleasant or dangerous gases through system leakage should be avoided, with consequent risks to working personnel, a further preferred embodiment involves carrying out the method under a certain degree of vacuum or negative pressure, conveniently by arranging a suction pump 52 or gas evacuation pump downstream of the demister/fiber bed scrubber 51.

The following especially preferred embodiments of the apparatus can be mentioned.

Preferably, the pyrolysis reactor 20 is a gravity reactor.

An optional condenser (not shown) for the condensation of tar products in the gas may be located prior the submerged bed heater 30.

A metal or ceramic filter (not shown) for the separation of any fly ash from the gas is preferably located in the pyrolysis reactor 20 and the steam reforming vessel 61.

Optionally, a compactor (not shown) may be included for compression of the carbon reduced pyrolysis residue 7 resulting from the steam reformer 61.

It is understood that various other modifications will be apparent to, and can be readily made by, those skilled in the art without departing from the scope and spirit of the present invention. Accordingly, it is not intended that the scope of the claims be limited to the description or illustrations set forth herein, but rather that the claims be construed as encompassing all features of patentable novelty that reside in the present invention, including all features that would be treated as equivalents by those skilled in the art.

What is claimed is:

1. A method for the volume reduction of solid organic waste from nuclear facilities, said method comprising:

(a) subjecting said organic waste to pyrolysis to form a gas which comprises organic compounds, said pyrolysis further forming a solid pyrolysis residue comprising residual carbon from said organic waste; and (b) gasifying via steam reforming solid pyrolysis residue to extract at least a portion of said residual carbon.

2. The method of claim 1 wherein said gasifying of said solid pyrolysis residue forms carbon dioxide and carbon monoxide.

3. The method for the volume reduction of solid organic waste of claim 1 wherein said pyrolysis is performed at a temperature of no more than 700° C.

4. The method for the volume reduction of solid organic waste of claim 1 wherein said pyrolysis is carried out in the absence of a catalyst for the breaking down of carbon compounds that are present in said organic waste.

5. The method for the volume reduction of solid organic waste of claim 1 wherein said solid organic waste is an ion exchange medium.

6. The method for the volume reduction of solid organic waste of claim 3 wherein said pyrolysis is performed at a temperature of no more than 600° C.

7. The method for the volume reduction of solid organic waste of claim 6 wherein said pyrolysis is performed at a temperature in the range of 450° C. to 550° C.

8. The method for the volume reduction of solid organic waste of claim 1 wherein said pyrolysis of said solid organic waste is performed for a residence time of less than 10 seconds.

9. The method for the volume reduction of solid organic waste of claim 8 wherein said pyrolysis of said solid organic waste is performed for a residence time of 5 to 8 seconds.

10. The method for the volume reduction of solid organic waste of claim 1 wherein said gasification of said solid pyrolysis residue reduces said solid pyrolysis residue by a factor of about 2 to 5 times.

11. The method of claim 1 further comprising the step of grinding said solid organic waste prior to pyrolysis.

12. The method of claim 11 further comprising the step of drying said ground organic waste prior to pyrolysis.

13. The method of claim 11 further comprising the step of adding iron powder to the ground organic waste prior to pyrolysis.

14. The method of claim 12 further comprising the step of adding iron powder to the dried ground organic waste powder prior to pyrolysis.

15. The method of claim 14 wherein said organic waste contains chlorine which combines with said iron powder to form $FeCl_2$.

16. The method of claim 14 wherein said organic waste contains sulfur which combines with said iron powder to form FeS and $FeS_2$.

17. The method for the volume reduction of solid organic waste of claim 1 wherein said solid pyrolysis residue comprises radioactive material.

18. A method for the processing of solid organic waste from nuclear facilities, said method comprising:

(a) subjecting said organic waste to pyrolysis to form a first gas comprising organic compounds, said pyrolysis further forming a solid pyrolysis residue comprising residual carbon from said organic waste;

(b) gasifying via steam reforming said solid pyrolysis residue to extract at least a portion of said residual carbon, said gasification forming a second gas and a solid waste residue; and (c) oxidizing said first gas and said second gas.

19. The method of claim 18 wherein said oxidizing step is performed in a submerged bed heater.

20. The method of claim 18 further comprising the step of grinding said organic waste.

21. The method of claim 20 further comprising the step of drying said organic waste.

22. The method of claim 20 further comprising the step of adding iron powder to said ground organic waste.

23. The method of claim 22 wherein said organic waste contains sulfur which combines with said iron powder to form FeS.

24. The method of claim 22 wherein said organic waste contains sulfur which combines with said iron powder to form $FeS_2$.

25. The method of claim 22 wherein said organic waste contains chlorine which combines with said iron powder to form FeCl.

26. The method of claim 18 further comprising the step of quickly reducing the temperature of the oxidized gases of step (c).

27. The method of claim 26 further comprising the step of removing residual acid gases from said reduced temperature oxidized gases.

28. The method of claim 27 wherein said removal of residual acid gases is performed by a fiber bed scrubber.

29. The method for the volume reduction of solid organic waste of claim 1, wherein said organic waste contains up to about 50 percent moisture content.

30. The method for the volume reduction of solid organic waste of claim 29, wherein said organic waste contains from about 10 to about 30 percent moisture content.

31. The method for the volume reduction of solid organic waste of claim 1, wherein said pyrolysis of said organic waste is performed in the presence of substoichiometric quantities of oxygen.

32. A method for the volume reduction of solid organic waste from nuclear facilities, said method comprising:

(a) adding iron powder to said solid organic waste;

(b) subjecting said organic waste to pyrolysis to form a gas which comprises organic compounds, said pyrolysis further forming a solid pyrolysis residue comprising residual carbon from said organic waste; and (c) gasifying said solid pyrolysis residue to extract at least a portion of said residual carbon.

33. The method of claim 32 further comprising the step of grinding said solid organic waste prior to pyrolysis.

34. The method of claim 32 further comprising the step of drying said solid organic waste prior to pyrolysis.

35. The method of claim 32 wherein said organic waste contains chlorine which combines with said iron powder to form $FeCl_2$.

36. The method of claim 32 wherein said organic waste contains sulfur which combines with said iron powder to form FeS and $FeS_2$.

37. A method for the processing of solid organic waste from nuclear facilities, said method comprising:

(a) subjecting said organic waste to pyrolysis to form a first gas comprising organic compounds, said pyrolysis further forming a solid pyrolysis residue comprising residual carbon from said organic waste;

(b) gasifying said solid pyrolysis residue to extract at least a portion of said residual carbon, said gasification forming a second gas and a solid waste residue; and (c) oxidizing said first gas and said second gas in a submerged bed heater.

38. A method for the processing of solid organic waste from nuclear facilities, said method comprising:

(a) subjecting said organic waste to pyrolysis to form a first gas comprising organic compounds, said pyrolysis further forming a solid pyrolysis residue comprising residual carbon from said organic waste;

(b) gasifying said solid pyrolysis residue to extract at least a portion of said residual carbon, said gasification forming a second gas and a solid waste residue;

(c) oxidizing said first gas and said second gas; and (d) removing residual acid gases from said oxidized gases wherein said removal is performed by a fiber bed scrubber.

39. The method of claim 38 further comprising the step of quickly reducing the temperature of the oxidized gases.

* * * * *